United States Patent [19]

Bourgeois

[11] Patent Number: 4,896,570

[45] Date of Patent: Jan. 30, 1990

[54] OIL FILTER WRENCH APPARATUS

[76] Inventor: Vernon S. Bourgeois, 248 Bluebird Dr., Slidell, La. 70458

[21] Appl. No.: 315,640

[22] Filed: Feb. 27, 1989

[51] Int. Cl.[4] ..... B25B 13/48; B25B 13/10

[52] U.S. Cl. ..... 81/64; 81/3.42; 81/3.43

[58] Field of Search ..... 81/64, 3.42, 3.4, 3.43, 81/57.21, 57.33, 57.34, 57.36

[56] References Cited

U.S. PATENT DOCUMENTS

| | | | |
|---|---|---|---|
| 3,119,290 | 1/1964 | Ivie | 81/3.42 |
| 3,124,984 | 3/1964 | Anderson | 81/64 |
| 3,853,026 | 12/1974 | Rhodes | 81/91 R |
| 4,114,481 | 9/1978 | Kowalczyk | 81/64 |
| 4,350,063 | 9/1982 | Koehler | 81/64 |
| 4,598,615 | 7/1986 | Tate | 81/64 |

FOREIGN PATENT DOCUMENTS

| | | | |
|---|---|---|---|
| 2035868 | 6/1980 | United Kingdom | 81/3.42 |

*Primary Examiner*—Roscoe V. Parker
*Attorney, Agent, or Firm*—Henderson & Sturm

[57] ABSTRACT

An oil filter wrench apparatus (10) used to remove or install an oil filter (100) wherein the wrench apparatus (10) includes a torque unit (11) which supports an inner (12) and an outer (13) clamp unit; wherein, the inner clamp unit (12) is adapted to engage the sides of an oil filter (100); and, be maintained in captive engagement with the oil filter (100) by virtue of the outer clamp unit (13) and/or an inner clamp immobilizing unit (15).

7 Claims, 2 Drawing Sheets

FIG. 1
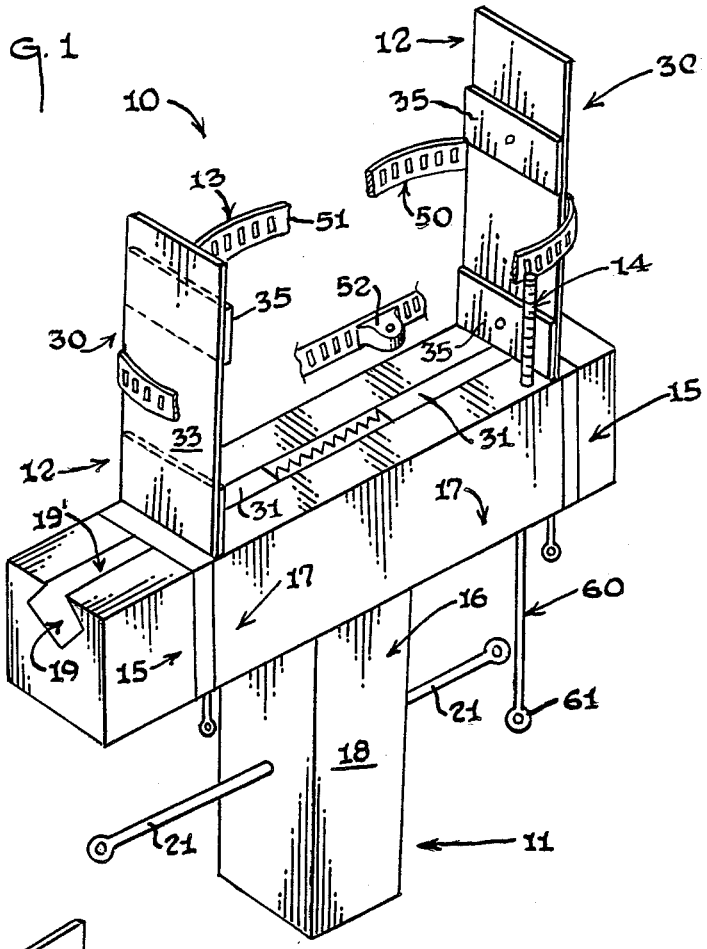
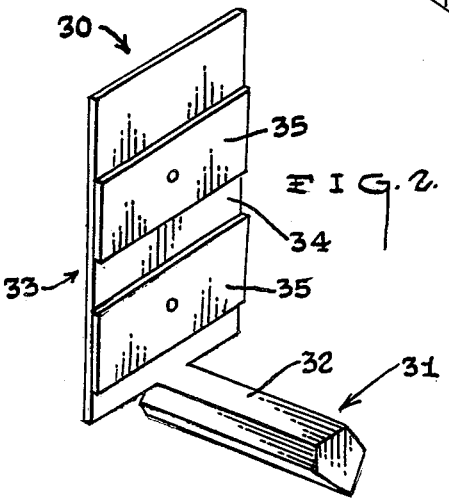
FIG. 2.
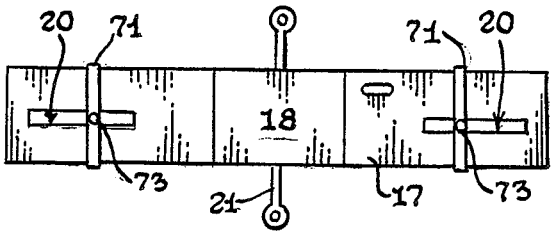
FIG. 3.

OIL FILTER WRENCH APPARATUS

TECHNICAL FIELD

The present invention relates generally to the field of wrenches, and more particularly to a specialized wrench for the installation and/or removal of an oil filter.

BACKGROUND OF THE INVENTION

As can be seen by reference to the following U.S. Pat. Nos. 3,124,984; 4,598,615; 4,114,481; and, 3,853,026 the prior art is replete with myriad and diverse wrench constructions that are designed specifically for the removal of oil filters.

While all of the aforementioned prior art devices are more than adequate for the basic purpose and function for which they have been specifically designed, these previously patented oil filter wrenches are deficient in a number of salient respects.

To begin with, most of the prior art devices employ a single contractable band to effect the frictional engagement between the wrench and the oil filter; and, should that single component experience structural failure the wrench is rendered inoperative.

This failure to provide redundancy in the prior art filter wrench constructions has created a longstanding problem for users of this type of a device; and, a stated objective of this invention is to cure that glaring oversight.

SUMMARY OF THE INVENTION

Briefly stated, the oil filter wrench apparatus that forms the basis of the present invention comprises a torque unit; an inner clamp unit; an outer clamp unit; an outer clamp tensioning unit; and, an inner clamp immobilizing unit.

The torque unit comprises in general: a T-shaped torque member wherein the arms of the torque member are provided with an elongated recess and a pair of apertures; and, the stem of the torque member is provided with a torque applying handle element.

The inner clamp unit comprises a pair of generally L-shaped clamp members wherein the foot of each of the clamp members is dimensioned to be slidably received in the elongated recess in the torque member.

The outer clamp unit comprises a generally circular adjustable length clamp member which is dimensioned to encircle and frictionally engage the inner clamp members against the opposed sides of an oil filter.

The outer clamp tensioning unit comprises an elongated tensioning member which operatively engages the adjustable length clamp member to bring the outer clamp unit into engagement with the inner clamp unit.

The inner clamp immobilizing unit comprises a pair of capture members which are slidably disposed on the outboard ends of the arms of the torque member; wherein, the capture members comprise an adjustable tension band and a tensioning element; whereby, the capture members may be brought into engagement with the rear surface of the inner clamp members to prevent the lateral displacement of the inner clamp members relative to one another and the oil filter.

BRIEF DESCRIPTION OF THE DRAWINGS

These and other objects, advantages, and novel features of the invention will become apparent from the detailed description of the best mode for carrying out the preferred embodiment of the invention which follows; particularly when considered in conjunction with the accompanying drawings, wherein:

FIG. 1 is a perspective view of the oil filter wrench apparatus of invention;

FIG. 2 is an isolated perspective view of one of the inner clamp member;

FIG. 3 is a bottom plan view of the apparatus;

BEST MODE FOR CARRYING OUT THE INVENTION

Figure 6:
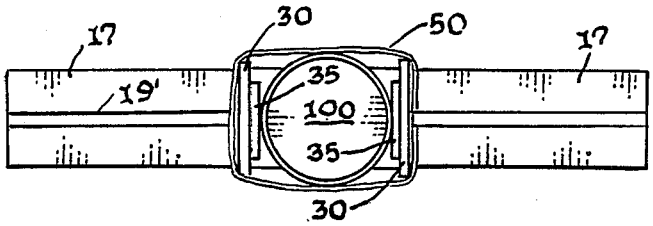

As can be seen by reference to the drawings and in particular to FIG. 1, the oil filter wrench apparatus that forms the basis of the present invention is designated generally by the reference numeral (10). The apparatus (10) comprises in general: a torque unit (11); an inner clamp unit (12); an outer clamp unit (13); an outer clamp tensioning unit (14); and an inner clam immobilizing unit (15). These units will now be described in seriatim fashion.

As can best be seen by reference to FIGS. 1 and 3 thru 5, the torque unit (11) comprises a generally T-shaped torque member (16) having a pair of arms (17) and a stem (18). In addition, the arms (17) are provided with an elongated recess (19) which extends along the length of each of the arms (17), and a pair of elongated apertures (20) which intersect the elongated recess (19) in each of the arms (17); and, the stem (18) is provided with a torque applying handle element (21) which projects from opposed sides of the stem (18). It should also be noted that the elongated recess (19) has a relatively narrow throat opening (19') on the top surface of the support arms (17) relative to the overall dimensions of the mouth of the recess (19) as viewed from the opposite ends of the arms (17).

Turning now to FIGS. 1 and 2, it can be seen that the inner clamp unit (12) comprises a pair of generally L-shaped clamp members (30); wherein, the foot (31) of each clamp member (30) includes a contoured dowel element (32) is dimensioned to be slidably received in the elongated recess (19) in the torque unit (11) such that the foot (31) of one clamp member (30) is facing the foot (31) of the other clamp member.

In addition, each of the clamp members (30) further comprises an upstanding leg member (33) which includes a generally flat clamp plate (34) having at least one high friction pad element (35) disposed on the inboard face of each clamp plate.

As can also best be seen by reference to FIG. 1, a helical spring element (40) is captively and slidably received within the elongated recess (19) in the torque unit (11) and disposed intermediate the opposed ends of the feet (31) of the clamp members (30); wherein the clamp members (30) are normally spring biased away from one another.

Figure 5:
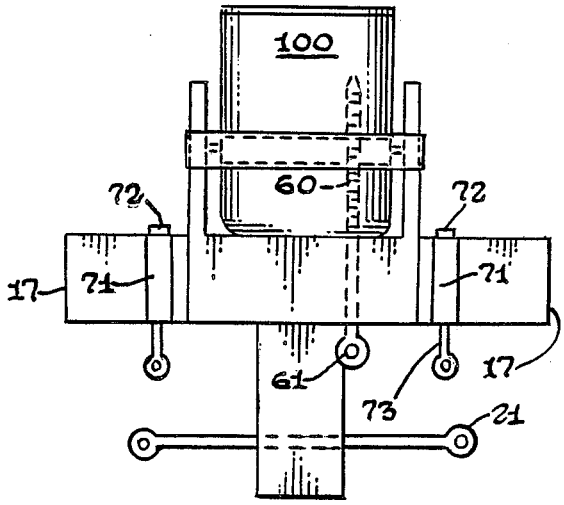
FIG. 5 is a side plan view of the apparatus engaged with an oil filter; and, FIG. 6 is a top plan view of the apparatus engaged with an oil filter.

Turning now to FIGS. 1, 5 and 6, it can be appreciated that the outer clamp unit (13) comprises a generally circular adjustable length clamp member (50), including a conventional apertured metal strap element (51) having a screw actuated strap advancing and retracting mechanism (52) that will vary the dimension of the loop formed by the adjustable length clamp member (50) in a well recognized fashion.

Still referring to FIGS. 1, 5 and 6, it can be appreciated that the outer clamp tensioning unit (14) comprises an elongated threaded screw member (60) which projects through a suitably dimensioned aperture in one of the arms (17) of the torque unit (11) and operatively engages the screw actuated strap advancing and retracting mechanism (52) to vary the loop formed by the outer clamp unit (13); whereby, the outer clamp unit (13) may be brought into frictional engagement with the inner clamp unit (12) to captively engage an oil filter receptacle (100). In addition, the elongated threaded screw member (60) is further provided with a knob element (61) to impart rotary movement of the screw member (60) relative to the screw actuated strap advancing and retracting mechanism (52).

Turning now to FIGS. 3 thru 6, it can be seen that the inner clamp immobilizing unit (15) comprises a pair of adjustable tension band members (70) wherein each of the adjustable tension band members (70) are operatively associated with one of the arms (17) of the torque unit (11) and the outboard face of one of the inner clamp members (30).

Figure 4:
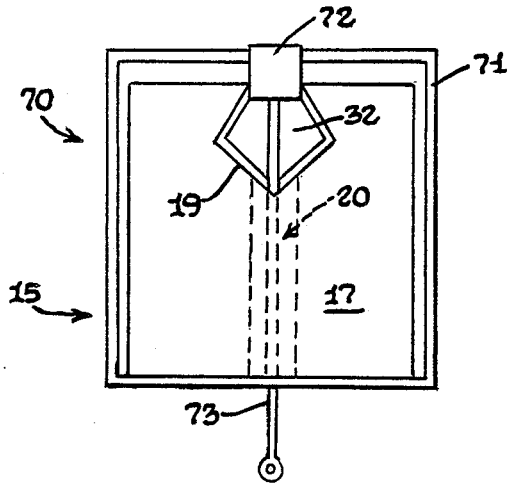
FIG. 4 is a an isolated end view of one arm of the torque member and one of the adjustable tension band and tensioning element.

As can best be seen by reference to FIGS. 3 and 4, each of the band members (70) comprises a generally flexible metal band element (71) that is dimensioned to encircle one of the arms (17) of the torque unit (11); wherein, each band element (71) is further provided with a threaded nut member (72) that operatively engages a portion of the band element (71). In addition, each nut member (72) is dimensioned to be received in the narrow neck (19') of the elongated recess (19) in the torque unit (11); and is further adapted to be engaged by an elongated threaded band tensioning member (73) which extends through one of the apertures (20) in the arms (17)of the torque unit (11).

As can also be seen particularly by reference to FIG. 4, the upper end of the tensioning member (73) is threadedly engaged with the nut member (72) while the lower portion of the tensioning member (73) projects through the band element (71) and is provided with a knob member (74) which can be actuated to bring the adjustable tensioning band members (70) into tight frictional engagement with the arms (17) of the torque unit (11) immediately adjacent and in a capturing relationship relative to the outboard ends of the inner clamp members (30) for purposes which will be explained presently.

When a user wishes to employ the oil filter wrench apparatus (10) of this invention to remove an oil filter (100) from a motor (not shown) they must first bring the inner clamp unit (11) into frictional engagement with the opposed sides of the oil filter by employing the outer clamp tensioning unit (14) to bring the outer clamp unit into tight engagement with the outboard surface of the inner clamp plates (33) which creates a tight frictional engagement between at least one frictional pad element (35) on each of the clamp plates (30) and the oil filter (100).

At this point the inner clamp immobilizing unit (15) is also brought into engagement with the outboard surface of the inner clamp members (30) and the tensioning member (73) is actuated to immobilize the inner clamp members (30) relative to the oil filter (100); in the event that the outer clamp unit (13) should fail.

Now all that is necessary is to rotate the torque unit (11) via the torque applying handle element (21) in the proper direction to effect either the engagement or disengagement of the oil filter (100) in its intended environment.

Having thereby described the subject matter of this invention it should be apparent that many substitutions, modifications, and variations of the invention are possible in light of the above teachings. It is therefore to be understood that the invention as taught and described herein is only to be limited to the extent of the breadth and scope of the appended claims.

I claim:

1. An oil filter wrench apparatus for use in combination with an oil filter wherein the apparatus comprises:
   a torque unit including a stem and a pair of arms;
   an inner clamp unit operatively associated with the arms of the torque unit and comprising a pair of clamp members having an inboard face and an outboard face wherein each of the inboard faces of the clamp members are provided with at least one friction pad element; and,
   means for contacting the outboard faces of said pair of clamp members to bring the inboard faces of the clamp members into engagement with the sides of an oil filter.

2. The apparatus as in claim 1 wherein said means for contacting the outboard faces of said pair of clamp members comprises:
   an outer clamp unit comprising a generally circular adjustable length clamp member adapted to encircle the outboard faces of said pair of clamp members.

3. The apparatus as in claim 2 wherein said means for contacting the outboard faces of said pair of clamp members further comprises:
   an inner clamp immobilizing unit comprising a pair of adjustable tension band members; wherein, each of said band members is operatively associated with one of the arms of the torque unit and adapted to be disposed adjacent to the outboard faces of the pair of clamp member in a capturing relationship.

4. The apparatus as in claim 1 wherein said means for contacting the outboard faces of said pair of clamp members comprises:
   an inner clamp immobilizing unit comprising a pair of adjustable tension band members; wherein, each of said band members is operatively associated with one of the arms of the torque unit and adapted to be disposed adjacent to the outboard faces of the pair of clamp members in a capturing relationship.

5. The apparatus as in claim 2 further comprising:
   an outer clamp tensioning unit adapted to operatively engage said outer clamp unit to vary the spacing between the inner clamp unit and said oil filter.

6. The apparatus as in claim 5 wherein said generally circular adjustable length clamp member comprises a strap element having a screw actuated strap advancing and retracting mechanism which is adapted to vary the size of a loop formed by said strap element.

7. The apparatus as in claim 6 wherein said outer clamp tensioning unit comprises a threaded screw member which operatively engages the screw actuated strap advancing and retracting mechanism on the strap element of said outer clamp unit.

* * * * *